US005129480A

United States Patent [19]

Garrett et al.

[11] Patent Number: 5,129,480

[45] Date of Patent: Jul. 14, 1992

[54] ARTICULATED PARALLELOGRAM BOOM ASSEMBLY SYNCHRONIZATION DEVICE

[75] Inventors: Gregory E. Garrett, Greenwood, Ind.; Geoffrey F. Wall, Dallastown, Pa.

[73] Assignee: Kidde Industries, Inc., Iselin, N.J.

[21] Appl. No.: 672,883

[22] Filed: Mar. 21, 1991

[51] Int. Cl.[5] ..... B66F 11/00

[52] U.S. Cl. ..... 182/63; 182/2; 182/141

[58] Field of Search ..... 182/63, 2, 141; 187/18, 187/9 R

[56] References Cited

U.S. PATENT DOCUMENTS 4,953,666 9/1990 Ridings ..... 182/63 X

*Primary Examiner*—Alvin C. Chin-Shue

*Attorney, Agent, or Firm*—Brady, O'Boyle & Gates

[57] ABSTRACT

A synchronization device for an articulated parallelogram boom assembly having a floating frame connected between an upper work platform carrying boom assembly, and a lower vehicle mounted boom assembly. The synchronization device is mounted on the floating frame and includes a slidable member and compression and tension links connected between the slidable member and the upper and lower boom assemblies. The synchronization device is constructed and arranged to maintain the included angles of the adjacent upper and lower boom assemblies substantially identical during the luffing movement of the boom assemblies so that the work platform is maintained parallel to the ground plane.

10 Claims, 5 Drawing Sheets

ARTICULATED PARALLELOGRAM BOOM ASSEMBLY SYNCHRONIZATION DEVICE

BACKGROUND OF THE INVENTION

The synchronization device of the present invention is adapted for use in an articulated parallelogram boom assembly for elevating a work platform of the type disclosed in U.S. Pat. No. 4,019,604, dated Apr. 26, 1977. This elevating platform apparatus includes a vehicle for carrying the articulated parallelogram boom assembly and associated platform. The lower boom assembly includes parallel compression and tension arms extending between and pivotally connected to the vehicle and a floating frame. The upper boom assembly also includes compression and tension arms extending between and pivotally connected to the floating frame and an end frame upon which the platform is mounted. An extensible hydraulic cylinder is connected between the vehicle chassis frame and lower compression arm for pivoting the lower boom assembly relative to the vehicle frame, whereby the floating frame is elevated while maintaining a steady level altitude. A rigid tension link is interconnected between the upper and lower compression arms of the two boom assemblies so as to impart a moment force which pivots the upper boom assembly relative to the floating frame and in synchronization with the lower boom assembly as it pivots relative to the vehicle, whereby the work platform is maintained parallel to the ground throughout the luffing range of the boom assembly.

While the synchronization device of the aforementioned patent consists of a tension link, other articulated parallelogram boom assemblies have been constructed and arranged so that the synchronization devices consists of a compression link, or meshing gears operatively connected between the upper and lower arms of the two boom assemblies.

While each of the prior art synchronization devices has been satisfactory for its intended purpose, after considerable research and experimentation the synchronization device of the present invention has been devised for use in lieu of the aforementioned tension link, compression link or gears to provide a more synchronized movement of the upper and lower boom assemblies.

SUMMARY OF THE INVENTION

The articulated parallelogram boom assembly synchronization device of the present invention comprises, essentially, a block slidably mounted on a frame assembly provided on the floating frame of the parallelogram boom assembly. A compression link has one end pivotally connected to the slide block and the opposite end pivotally connected to the end portion of the lower compression arm, and a tension link has one end pivotally connected to the slide block and the opposite end pivotally connected to the end portion of the upper compression arm which is adjacent to the corresponding end portion of the lower compression arm. During the actuation of the boom assembly to raise and lower the work platform straight up and down throughout its elevation range, the pivotal movement of the compression and tension links causes the block to slide on the frame assembly and impart a moment force which pivots the upper boom assembly relative to the floating frame and in synchronization with the lower boom assembly during its pivotal movement, whereby the included angles between the horizontal and the arms of the adjacent upper and lower boom assemblies remain substantially identical with each other, to thereby maintain the work platform parallel to the ground plane.

DESCRIPTION OF THE PREFERRED EMBODIMENT

Figure 1:
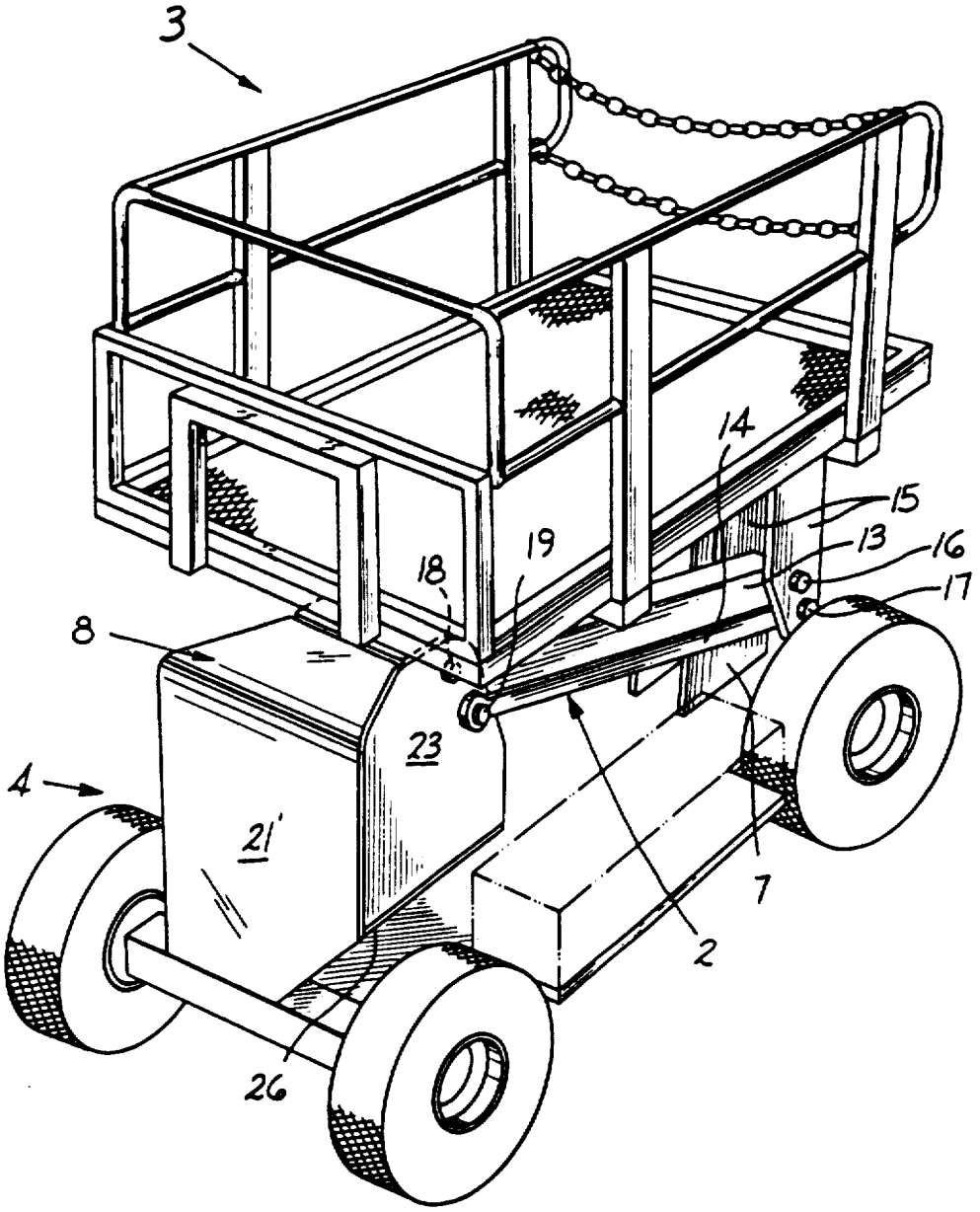
FIG. 1 is a perspective view of the type of articulated parallelogram boom assembly for elevating a work platform employing a synchronization device of the present invention.
Figure 2:
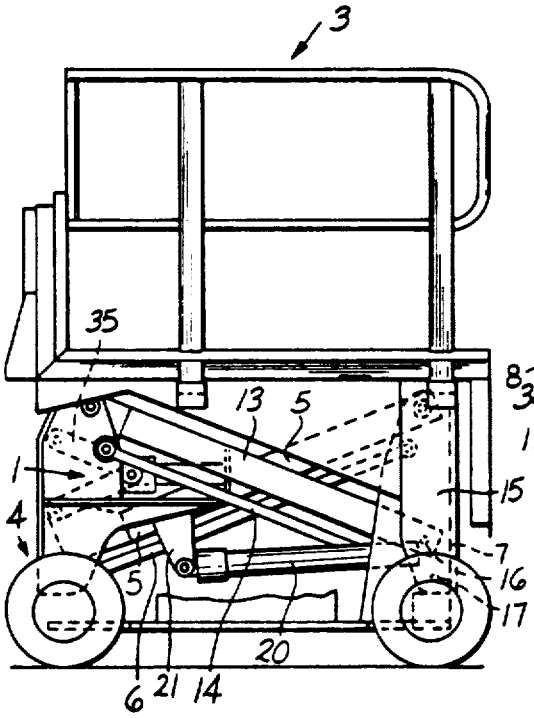
FIG. 2 is a side elevational view of the boom assembly showing the relative positions of the parallelogram compression and tension arms and the synchronization device of the present invention when the work platform is in the lowermost positions.
Figure 3:
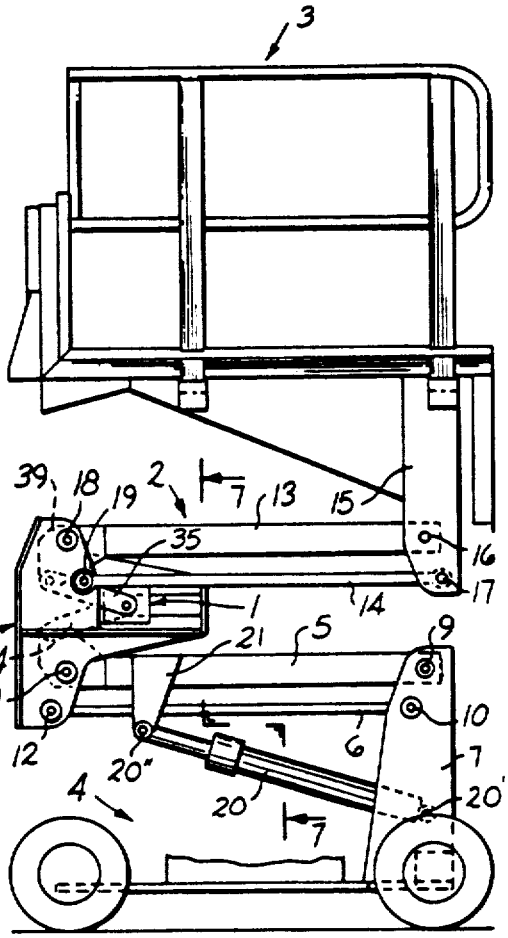
FIG. 3 is a side elevational view of the boom assembly similar to FIG. 2 but showing the relative positions of the various components during the raising of the work platform.
Figure 4:
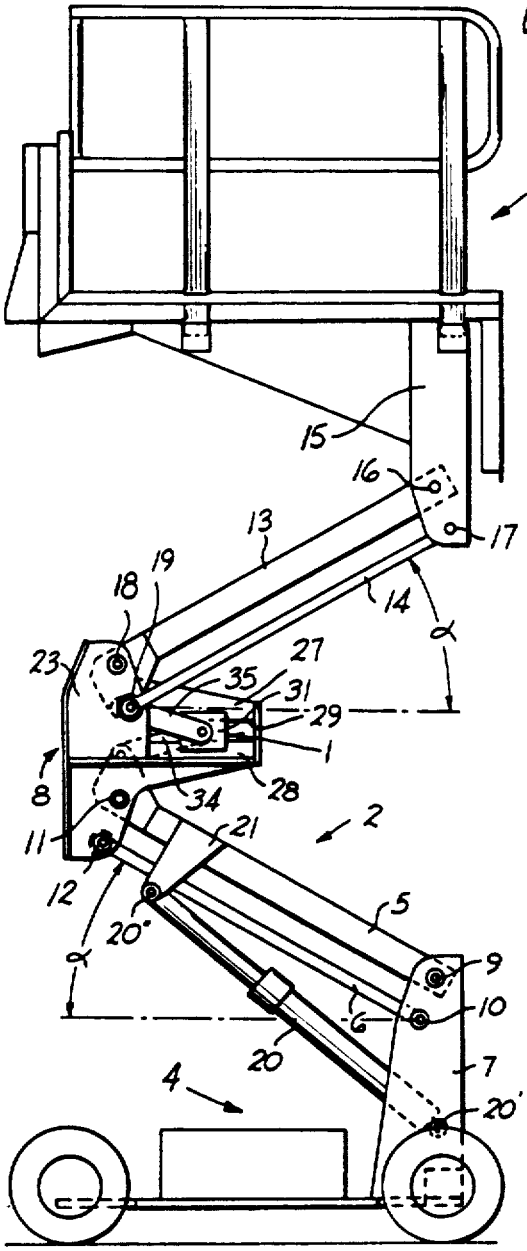
FIG. 4 is a side elevational view similar to FIGS. 2 and 3, showing the platform being raised toward the uppermost position.
Figure 5:
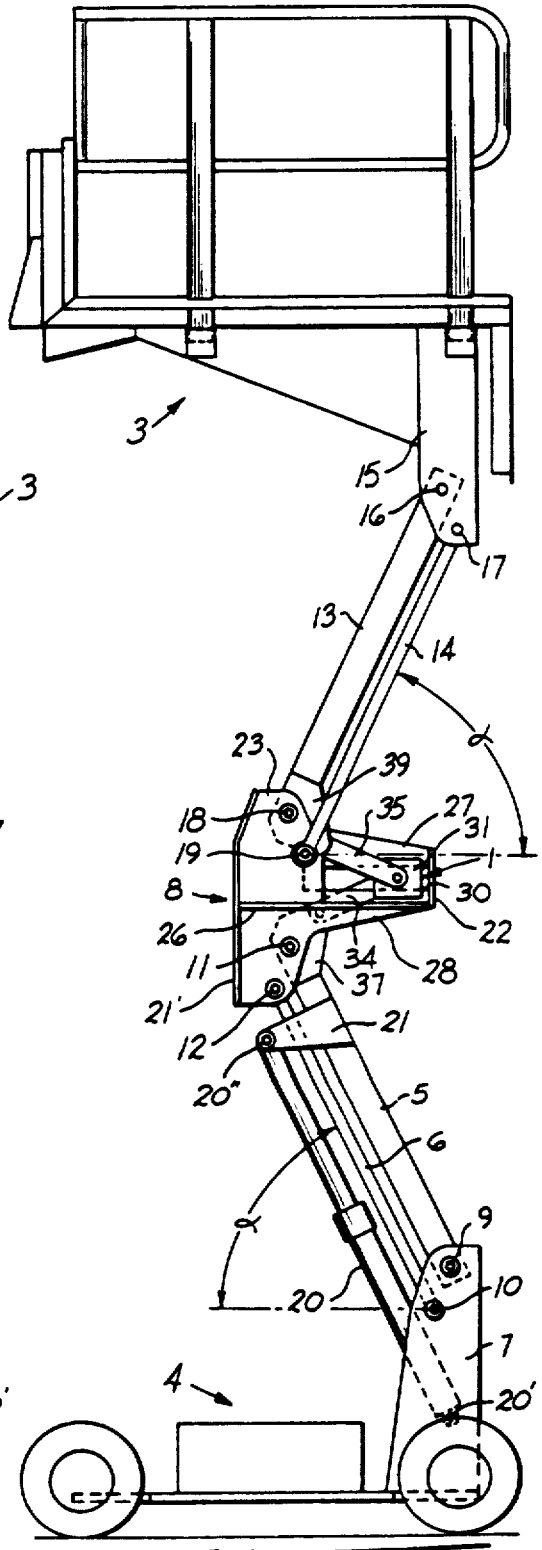
FIG. 5 is a side elevational view similar to FIG. 4 showing the relative positions of the various components when the platform has reached the uppermost position.

Referring to the drawings and more particularly to FIGS. 1 to 5, the synchronization device 1 of the present invention is adapted for use in an articulated parallelogram boom assembly 2 for elevating a work platform 3 mounted on a vehicle 4. The articulated parallelogram boom assembly includes a lower boom assembly, offset to the back side of the centerline of the vehicle as seen in FIGS. 1-5, having parallel compression and tension arms 5 and 6, respectively, extending between vehicle frame 7 and a floating frame 8, the arms being pivotally connected to the vehicle frame as at 9 and 10, and to the floating frame as at 11 and 12, respectively.

The articulated parallelogram boom assembly also includes an upper boom assembly, offset to the front side of the centerline of the vehicle as seen in FIGS. 1-5, having parallel compression and tension arms 13 and 14, respectively, extending between the platform frame 15 and the floating frame 8, the arms being pivotally connected to the platform frame as at 16 and 17, and to the floating frame as at 18 and 19, respectively.

An extensible hydraulic cylinder 20 is pivotally connected between the vehicle frame 7 at 20' and a depending bracket 21 at 20" that is integral with the lower compression arm 5, for pivoting the lower boom assembly relative to the vehicle frame, whereby the floating frame 7 is elevated upon extension of cylinder 20.

Figure 6:
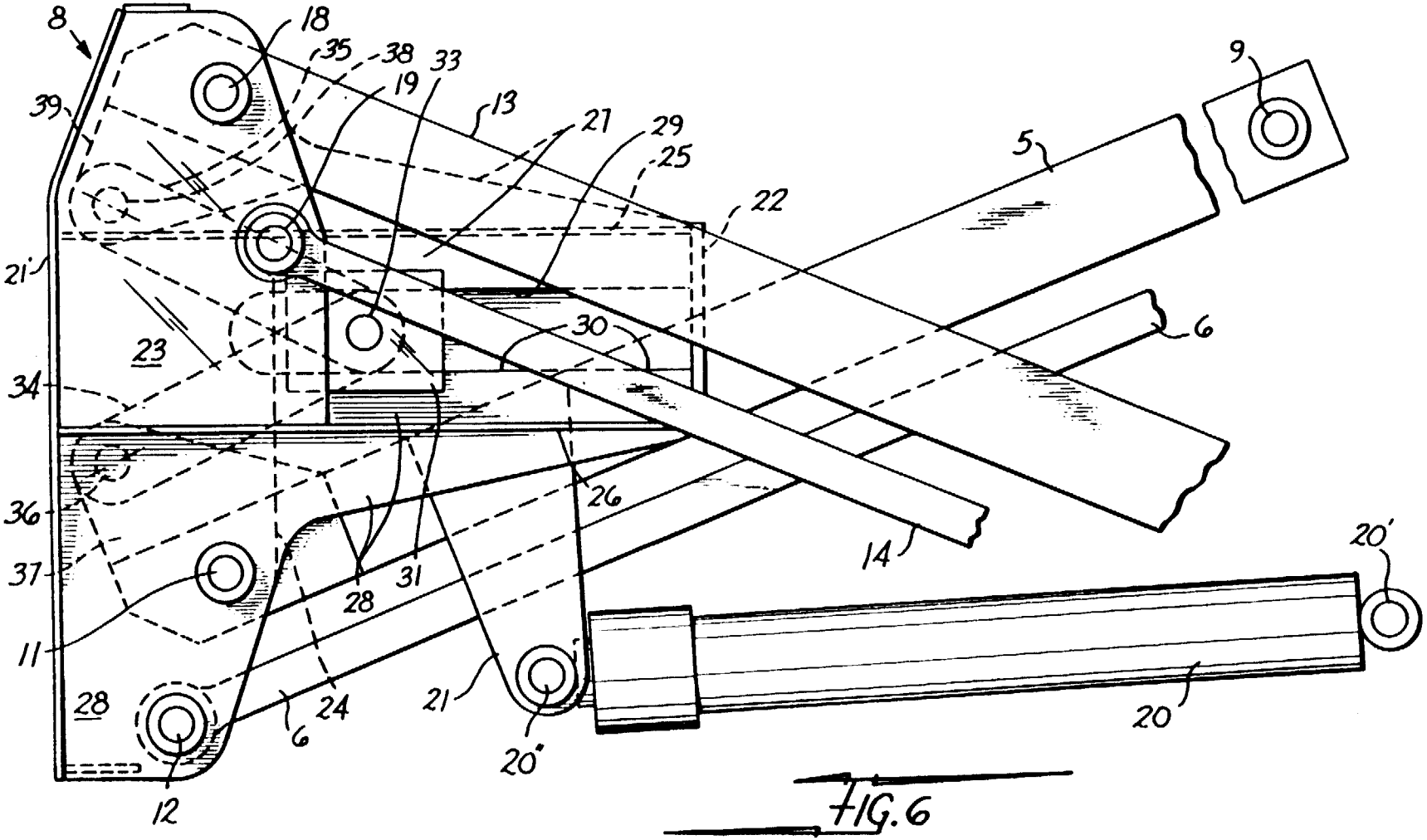
FIG. 6 is an enlarged, fragmentary side elevational view of the synchronization device of the present invention.
Figure 7:
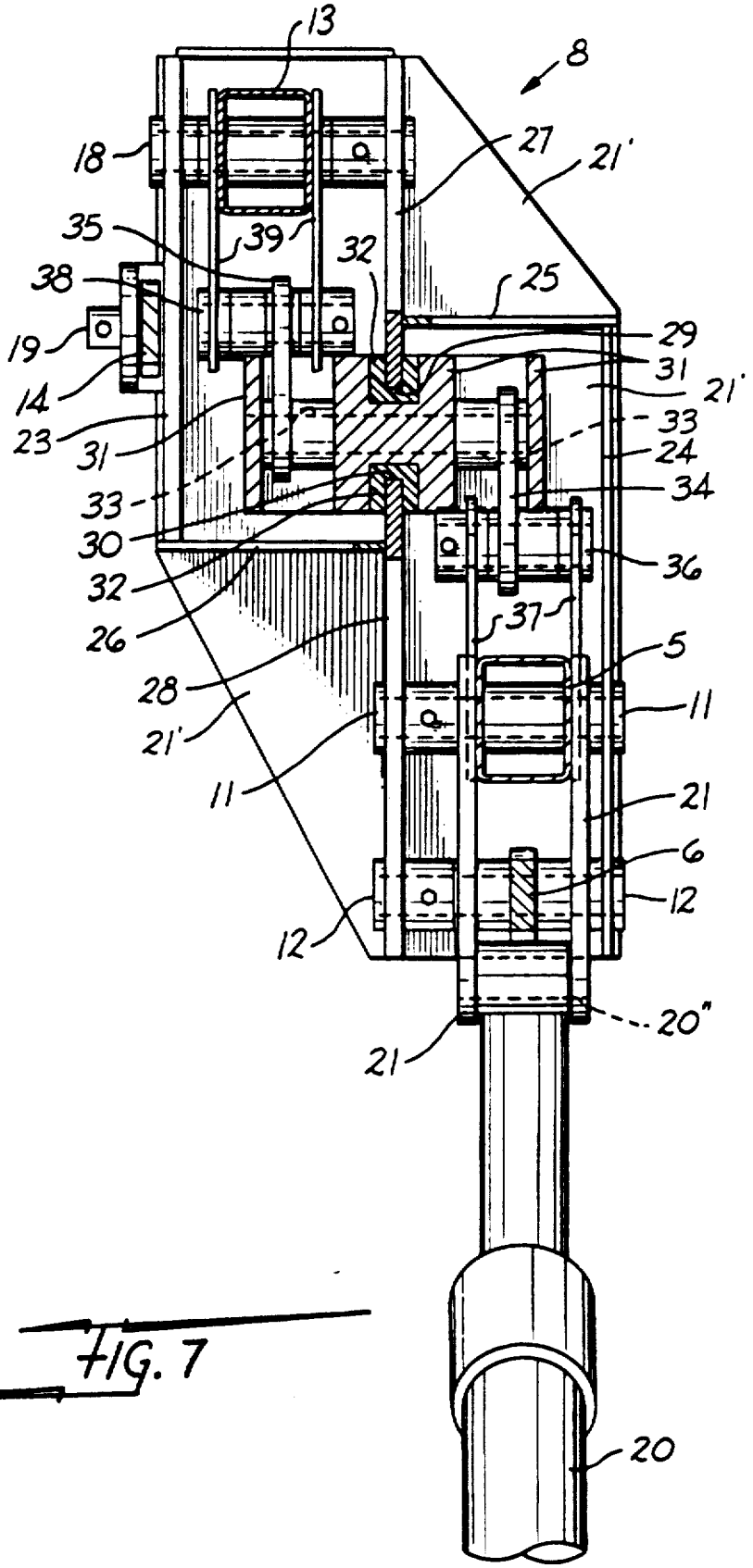
FIG. 7 is a view taken along line 7—7 of FIG. 3.

In order that the upper boom assembly be pivoted relative to the floating frame 8 in synchronization with the lower boom assembly as it pivots relative to the vehicle to thereby maintain the work platform 3 parallel to the ground, the synchronization device 1 of the present invention is provided, the details of which are illustrated in FIGS. 6 and 7. The floating frame 8, includes a rear end wall 21', a front wall 22, side walls 23 and 24, a top wall 25 and a bottom wall 26 all welded together to form a rigid frame.

The frame assembly for the synchronization device comprises a fixed bifurcated plate having leg members 27 and 28 integral with the back wall 21', front wall 22, top wall 25 and bottom wall 26 of the floating frame 8. The corresponding edge portions 29 and 30 of the plate leg members 27 and 28 are spaced from each other and provide a track upon which a block 31 is slidably mounted. To facilitate the sliding movement of the block 31 on the edge portions 29 and 30 of the plates, and to prevent premature wear, the block is provided with a pair of grooved plastics material inserts 32, such as Nylatron, on its upper and lower sides, that run the length of the block, and which slide on the edge portions 29 and 30 as the block 31 slides back and forth in the slot or space between the edge portions. A pivot pin 33 extends through the block 31, and is pivotally connected at one end to one end of a compression link 34, and at the other end to one end of a tension link 35.

The opposite end of the compression link 34 is pivotally connected as at 36 to a bracket 37 integral with the end portion of the lower compression arm 5. The opposite end of the tension link 35 is similarly pivotally connected as at 38 to a depending bracket 39 integral with the end portion of the upper compression arm 13.

In the operation of the synchronization device, as will be seen in FIGS. 2 to 5, during the extension of the hydraulic cylinder 20, the upper and lower boom assemblies are caused to move in the counter-clockwise and clockwise directions, respectively, as illustrated. During this movement link 34 is subjected to a compressive force, and link 35 is subjected to a tension force, while the block 31 simultaneously slides on the edge portions 29 and 30 of plate leg members 27 and 28, in the longitudinal slot formed between the edge portions. The combined compressive and tension forces of the links 34 and 35 impart a moment force which pivots the upper boom assembly relative to the floating frame 8 and in synchronization with the lower boom assembly during the luffing movement thereof relative to the vehicle 4. By this construction and arrangement, the included angle $\alpha$ of the adjacent upper and lower arms 13, 14 and 5, 6, of the upper and lower boom assemblies, remain substantially identical, whereby the work platform 3 is maintained parallel to the ground plane. The block 31, 32, links 34 and 35, and the related components are designed as shown to provide high accuracy and high mechanical efficiency in vertically moving the work platform straight up and down between its lowered and raised positions, and vice versa.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed. One of such modifications within the scope of the invention claimed, but not shown in the drawings, includes in lieu of the wear pad inserts 32 in the block 31, wear pad plates connected on and extending the lengths of edge portions 29 and 30, and being of a width to span the width of the groove in the block 31 without the inserts 32 therein, so that the grooves are in sliding contact with the stationary wear pad plates. In this form, the block 31 also does not necessarily require grooves in the top and bottom surfaces where the inserts 32 would be, but instead could have smooth top and bottom surfaces in sliding contact with the wear pad plates that extend the lengths of edge portions 29 and 30.

Another of such modifications within the scope of the invention claimed, but not shown in the drawings, for instance, is to eliminate the sliding block 31 and inserts 32 completely, and construct pivot pin 33 as a smooth cylindrical steel pivot shaft of larger cross-section than shown, in sliding contact with the edge portions 29 and 30 on the frame assembly, or in sliding contact with wear pad plates connected on and extending the lengths of the edge portions 29 and 30, the larger diameter cylindrical steel pivot shaft may be locally flattened in the area in sliding contact with the wear pad plates.

We claim:

1. In an articulated parallelogram boom assembly for elevating a work platform of the type including at least a lower boom assembly having parallel compression and tension arms extending between and pivotally connected to a vehicle frame and a floating frame; an upper boom assembly having parallel compression and tension arms extending between and pivotally connected to the floating frame and a frame connected with the platform, and an extensible hydraulic cylinder connected to luff the lower compression arm between lowered and raised positions, the improvement comprising a synchronization device operatively connected to the floating frame and adjacent end portions of the upper and lower compression arms, whereby the included angles of the adjacent upper and lower boom assemblies are maintained substantially the same, to thereby maintain the work platform parallel to the ground plane during the luffing movement of the boom assembly.

2. In an articulated parallelogram boom assembly according to claim 1, wherein the synchronization device comprises, a compression link, a tension link, means slidably mounted on the floating frame, said compression link and said tension link each having one end portion pivotally connected to said means, said compression link having an opposite end pivotally connected to an end portion of the lower compression arm, and said tension link having an opposite end pivotally connected to an end portion of the upper compression arm.

3. In an articulated parallelogram boom assembly according to claim 1, wherein the synchronization device comprises, a block slidably mounted on the floating frame, a compression link having one end portion pivotally connected to the block and the opposite end pivotally connected to an end portion of the lower compression arm, and a tension link having one end pivotally connected to the block and the opposite end pivotally connected to an end portion of the upper compression arm.

4. In an articulated parallelogram boom assembly according to claim 2, wherein the floating frame includes fixed downwardly and upwardly aligned plate portions, a lower edge on the upper plate portion being spaced from an upper edge on the lower plate portion, said means being positioned in the space between the upper and lower plate portions, the lower and upper edges of said plate portions providing a track for said means slidably mounted therebetween.

5. In an articulated parallelogram boom assembly according to claim 4, including wear surface means connected between said slidably mounted means and the lower and upper edges of said plate portions.

6. In an articulated parallelogram boom assembly for elevating a work platform of the type including a lower boom assembly having parallel compression and tension arms extending between and pivotally connected to a vehicle frame and a floating frame; an upper boom assembly having parallel compression and tension arms extending between and pivotally connected to the floating frame and a frame upon which the platform is mounted, and an extensible hydraulic cylinder connected between the vehicle frame and the lower compression arm, the improvement comprising a synchronization device including a block slidably mounted on the floating frame, a compression link having one end portion pivotally connected to said block and having an opposite end portion pivotally connected to an end portion of the lower compression arm, and a tension link having one end portion pivotally connected to said block and having an opposite end portion pivotally connected to an end portion of the upper compression arm, to thereby maintain the work platform parallel to the ground during luffing movement of the boom assembly.

7. In an articulated parallelogram boom assembly according to claim 6, wherein the floating frame includes fixed downwardly and upwardly aligned plate portions, a lower edge on the upper plate portion being spaced from an upper edge on the lower plate portion, said block being positioned in the space between the upper and lower plate portions, the lower and upper edges of said plate portions extending with said block to thereby provide a track for said block slidably mounted thereon.

8. In an articulated parallelogram boom assembly according to claim 7, wherein inserts of plastic material are provided in said block, the lower and upper edges of said plate portions extending into said inserts.

9. In an articulated parallelogram boom assembly according to claim 7, including wear surface means of plastic material connected between said block and the lower and upper edges of said plate portions.

10. In an articulated parallelogram boom assembly according to claim 6, wherein the end portion of the lower compression arm includes a bracket integrally connected to the end of the lower compression arm and extending upwardly therefrom, and the end portion of the upper compression arm including a bracket integrally connected to the end of the upper compression arm and extending downwardly therefrom, the opposite ends of said compression and tension links being pivotally connected to the respective brackets.

* * * * *